US007798231B2

(12) United States Patent
Ford

(10) Patent No.: US 7,798,231 B2
(45) Date of Patent: Sep. 21, 2010

(54) ADAPTER SLEEVE FOR WELLHEAD HOUSING

(75) Inventor: David L. Ford, Katy, TX (US)

(73) Assignee: Vetco Gray Inc., Houston, TX (US)

( * ) Notice: Subject to any disclaimer, the term of this patent is extended or adjusted under 35 U.S.C. 154(b) by 761 days.

(21) Appl. No.: 11/481,587

(22) Filed: Jul. 6, 2006

(65) Prior Publication Data

US 2008/0006412 A1 Jan. 10, 2008

(51) Int. Cl.
*E21B 29/12* (2006.01)
*E21B 33/14* (2006.01)

(52) U.S. Cl. ..... 166/337; 166/348; 166/368; 166/382; 166/88.1; 166/89.3

(58) Field of Classification Search ..... 166/336, 166/337, 346, 344, 348, 368, 88.4, 95.1, 166/88.1, 89.1, 242.1, 382, 89.3, 208
See application file for complete search history.

(56) References Cited

U.S. PATENT DOCUMENTS 3,459,259 A * 8/1969 Matthews ..... 166/358
4,583,746 A * 4/1986 Lawson ..... 277/314
4,790,572 A * 12/1988 Slyker ..... 285/123.12
4,807,705 A 2/1989 Henderson et al.
4,903,774 A * 2/1990 Dykes et al. ..... 166/363
4,911,244 A * 3/1990 Hynes ..... 166/368
5,025,864 A * 6/1991 Nobileau ..... 166/348
5,066,048 A * 11/1991 Farrell ..... 285/18
5,129,660 A * 7/1992 Taylor et al. ..... 277/328
5,159,982 A * 11/1992 Hynes ..... 166/345
5,240,081 A * 8/1993 Milberger et al. ..... 175/8
5,299,643 A 4/1994 Vetter et al.
5,366,017 A * 11/1994 Voss, Jr. ..... 166/368
5,450,905 A * 9/1995 Brammer et al. ..... 166/348
5,544,707 A * 8/1996 Hopper et al. ..... 166/382
5,944,111 A * 8/1999 Bridges ..... 166/348
6,039,119 A * 3/2000 Hopper et al. ..... 166/368
6,076,605 A 6/2000 Lilley et al.
6,186,236 B1 * 2/2001 Cox ..... 166/308.1
6,253,854 B1 7/2001 Fenton
6,293,345 B1 * 9/2001 Watkins ..... 166/368
6,302,211 B1 * 10/2001 Nelson et al. ..... 166/348

(Continued)

FOREIGN PATENT DOCUMENTS

GB 2114631 A 8/1983

(Continued)

*Primary Examiner*—Thomas A Beach
(74) *Attorney, Agent, or Firm*—Bracewell & Giuliani

(57) ABSTRACT

A subsea wellhead assembly for a subsea well including a low pressure wellhead housing having a string of conductor piping extending therefrom. A high pressure wellhead housing, having a string of outer casing suspended therefrom, lands within the low pressure wellhead housing. The high pressure wellhead housing has a housing bore. An adapter is positioned within the housing bore. The adapter has an external load shoulder that lands on a housing load shoulder of the high pressure wellhead housing. The adapter also has an adapter bore with an inner adapter load shoulder formed thereon. A casing hanger is carried in the adapter bore, and has a string of inner casing suspended therefrom and is cemented in the well. The casing hanger lands on the inner adapter load shoulder.

15 Claims, 5 Drawing Sheets

U.S. PATENT DOCUMENTS

| | | | | |
|---|---|---|---|---|
| 6,302,212 | B1 * | 10/2001 | Nobileau | 166/368 |
| 6,360,822 | B1 * | 3/2002 | Robertson | 166/368 |
| 6,394,194 | B1 * | 5/2002 | Queen et al. | 175/66 |
| 6,474,417 | B1 * | 11/2002 | Blair et al. | 166/368 |
| 6,494,267 | B2 * | 12/2002 | Allen | 166/347 |
| 6,513,596 | B2 * | 2/2003 | Wester | 166/336 |
| 6,557,638 | B2 * | 5/2003 | Cunningham et al. | 166/348 |
| 6,640,902 | B2 * | 11/2003 | Baten et al. | 166/368 |
| 6,668,919 | B2 * | 12/2003 | Radi | 166/208 |
| 6,705,401 | B2 | 3/2004 | Buckle et al. | |
| 6,708,766 | B2 * | 3/2004 | Clark | 166/368 |
| 7,073,591 | B2 * | 7/2006 | Massie et al. | 166/348 |
| 2006/0191680 | A1 * | 8/2006 | Nelson | 166/208 |

FOREIGN PATENT DOCUMENTS

| | | | |
|---|---|---|---|
| WO | WO 90/06419 | | 6/1990 |
| WO | WO 02/084069 | A1 | 10/2002 |

* cited by examiner

ADAPTER SLEEVE FOR WELLHEAD HOUSING

BACKGROUND OF THE INVENTION

1. Field of the Invention

This invention relates in general to subsea wellhead assemblies, and specifically for an adapter having an inner profile of a wellhead housing to be placed within a larger wellhead housing.

2. Background of the Invention

When drilling subsea wells, a low pressure wellhead housing is installed with a string of conductor casing or pipe extending therefrom into the sea floor. A high pressure wellhead housing is then landed in the bore of the high pressure wellhead housing with another string casing extending therefrom to a deeper depth. Additional strings of casing that extend deeper into the subsea well, until at least one string reaches a production depth, are suspended from casing hangers landed within the bore of the high pressure housing. A tubing hanger is then landed for supporting a sting of production tubing that receives the hydrocarbons from the subsea well after the deepest string of casing is perforated.

A standard high pressure wellhead housing has either an 18¾ inch inner diameter, or a 13⅝ inch inner diameter upon which the casing hangers land upon. As is readily understood by those skilled in the art, a casing hanger designed to land within an 13⅝ inch high pressure wellhead housing cannot engage the bore of the high pressure wellhead housing as is required. Therefore, once the high pressure wellhead housing is in place, previous assemblies required using the compatible casing hanger and tubing hanger assemblies.

A drilling vessel can complete all of these tasks at once. However, sometimes drilling ships pre-drill numerous subsea wells by drilling and installing only the low pressure and high pressure wellhead housings with their associated strings of casing. This allows the drilling ship to keep a supply of the same equipment, and move quickly from one proposed subea well to another. Later a drilling vessel comes along and drills further down to install the inner casings and casing hangers, as well as performing the tasks associated with completing the subsea wells. These drilling vessels have the pressure control equipment for performing the deeper drilling and completion operations.

A drilling operator may only have 13⅝ inch casing hangers available at a particular time, or the drilling operator may realize that it may be less expensive to drill through a subsea tree assembly rather than with a drilling riser and blowout preventer (BOP) assembly. The typical subsea tree assembly cannot have an 18¾ inch casing hanger lowered therethrough to the high pressure wellhead housing, but can accommodate a 13⅝ inch casing hanger. As is also readily appreciated by those skilled in the art, a narrower drilling riser is also less expensive to use than a drilling riser for that can be used to lower a 18¾ inch casing hanger. It may be advantageous to use smaller drilling riser simply because of costs of operation rather than a scarceness of correctly-sized casing hangers. However, in previous operations the operator was left without options once a high pressure wellhead housing with an 18¾ inch inner diameter was installed.

SUMMARY OF THE INVENTION

A subsea wellhead assembly for a subsea well including a low pressure wellhead housing having a string of conductor piping extending therefrom. A high pressure wellhead housing, having a string of outer casing suspended therefrom, lands within the low pressure wellhead housing. The high pressure wellhead housing has a housing bore. An adapter is positioned within the housing bore. The adapter has an external load shoulder that lands on a housing load shoulder of the high pressure wellhead housing. The adapter also has an adapter bore with an inner adapter load shoulder formed thereon. A casing hanger is carried in the adapter bore, and has a string of inner casing suspended therefrom and is cemented in the well. The casing hanger lands on the inner adapter load shoulder.

In the subsea wellhead assembly a maximum sidewall thickness of the adapter can be greater than a maximum sidewall thickness of the casing hanger. A lower end of the adapter can also be free of connection to any conduit extending into the well. A lower end of the adapter can be free of connection to any conduit extending into the well, and can be axially below a lower end of the high pressure wellhead housing.

The subsea wellhead assembly can also have a plurality of flow by ports extending from a lower end portion of the adapter and opening into the adapter bore above the adapter load shoulder. The casing hanger can also have a hanger seal assembly that sealingly engages the casing hanger with the adapter bore. A tubing hanger can also support a string of production tubing therefrom, with the string of production tubing extending axially through the casing hanger and the string of inner casing to a production depth within the well.

In the subsea wellhead assembly, the high pressure wellhead housing can also have an interior profile formed on the housing bore axially above the load shoulder of the high pressure wellhead housing, the adapter can have a locking member. The locking member can be operable to engage and disengage the interior profile. The adapter can also further have an adapter seal assembly that sealingly engages the housing bore above the interior profile.

The subsea wellhead assembly can also have a subsea tree assembly connecting to an exterior profile formed on the exterior surface of the high pressure wellhead housing, and a tubing hanger supporting a string of production tubing extending axially through from the subsea tree assembly through the casing hanger.

A subsea wellhead assembly for a subsea well includes a low pressure wellhead housing having a string of conductor piping extending therefrom. A high pressure wellhead housing, having a string of outer casing suspended therefrom, lands within the low pressure wellhead housing. The high pressure wellhead housing has a housing bore with a housing load shoulder formed therein, and an interior profile formed in the housing bore axially above the housing load shoulder. An adapter is positioned within the housing bore. The adapter has an external load shoulder that lands on the housing load shoulder, an adapter bore with an inner adapter load shoulder formed thereon, and a locking member operable to engage and disengage the interior profile. A casing hanger is carried in the adapter bore, and has a string of inner casing suspended therefrom. The casing hanger landing on the inner adapter load shoulder. A plurality of flow by ports are formed in the adapter that extend from a lower end portion of the adapter and open into the adapter bore above the adapter load shoulder.

In the subsea wellhead, a lower end of the adapter can be free of connection to any conduit extending into the well, and a lowermost end of the adapter can be axially below a lower end of the high pressure wellhead housing. The casing hanger can have a hanger seal assembly that sealingly engages the casing hanger with the adapter bore, and the adapter can have an adapter seal assembly that sealingly engages the adapter with the housing bore above the interior profile.

The subsea wellhead assembly can also have a subsea tree assembly connecting to an exterior profile formed on the exterior surface of the high pressure wellhead housing, and a tubing hanger supporting a string of production tubing extending axially from subsea tree assembly through the casing hanger and the string of inner casing to a production depth within the well. The tubing hanger can be carried within in the subsea tree, or the tubing hanger can land within the adapter.

A method of landing a casing hanger and a string of casing suspended therefrom within a subsea wellhead housing includes providing a low pressure wellhead housing having a string of conductor piping extending therefrom, and cemented into place within a subsea well. The method also includes landing a high pressure wellhead housing with a string of outer casing suspended therefrom within the low pressure wellhead housing, and cementing the outer casing in the subsea well. Then positioning an adapter within the housing bore. A casing hanger with a string of inner casing attached thereto are then landed on a load shoulder formed in a bore of the tubular member. Then the sting of inner casing is cemented in the subsea well.

In the method, the positioning an adapter within the housing bore can be is performed on a vessel at the surface of the sea, or with a lift line.

Prior to landing the casing hanger with its associated string of casing, an assembly is selected from a group consisting of a subsea tree assembly and a blow out preventer with riser assembly is connected to the high pressure wellhead housing, the casing hanger and the string of inner casing is lowered through the selected assembly.

DETAILED DESCRIPTION OF THE PREFERRED EMBODIMENT

Figure 1:
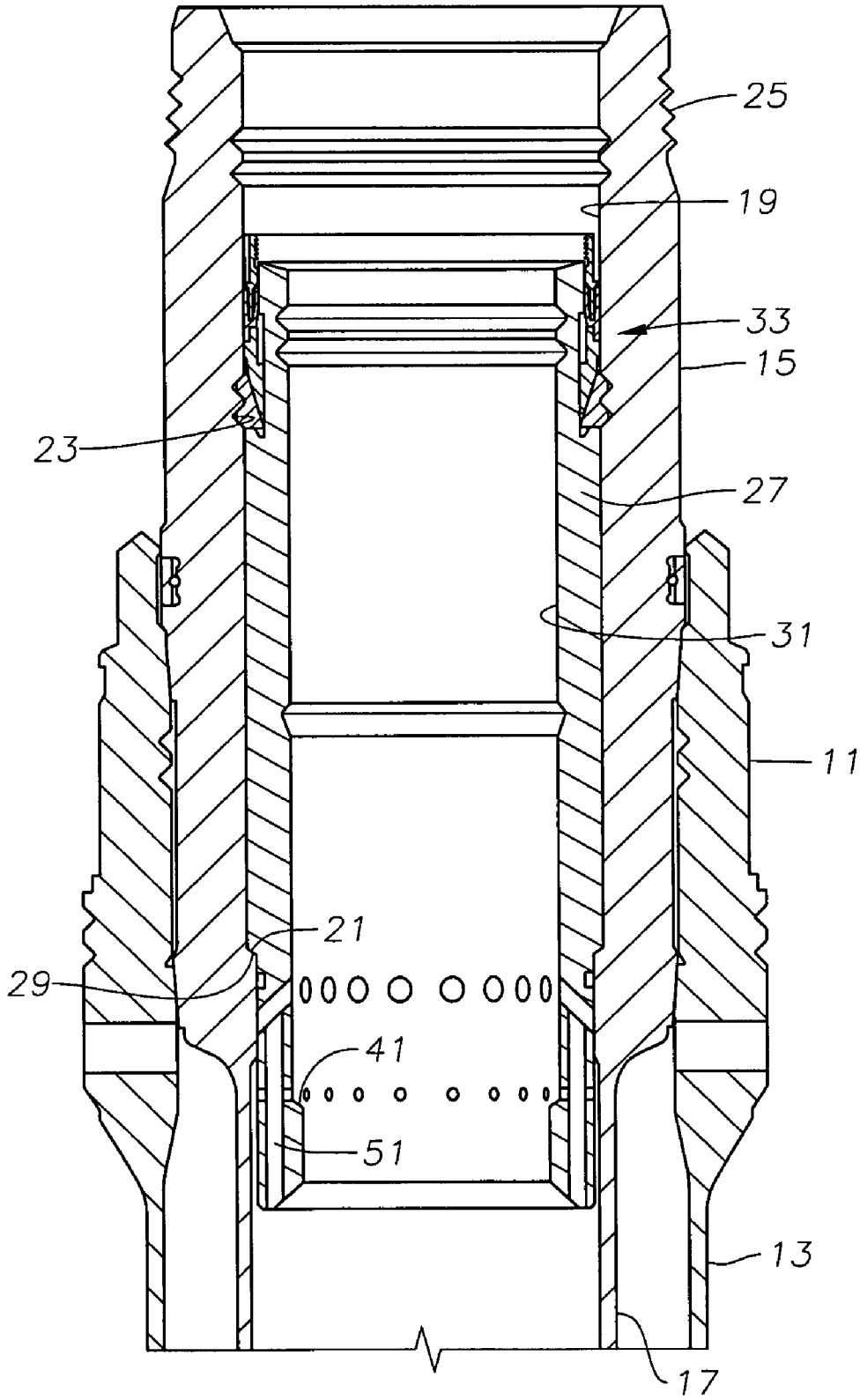
FIG. 1 is a sectional view of an adapter or adapter sleeve positioned within a high pressure wellhead housing of a subsea well constructed in accordance with this invention.
Figure 2:
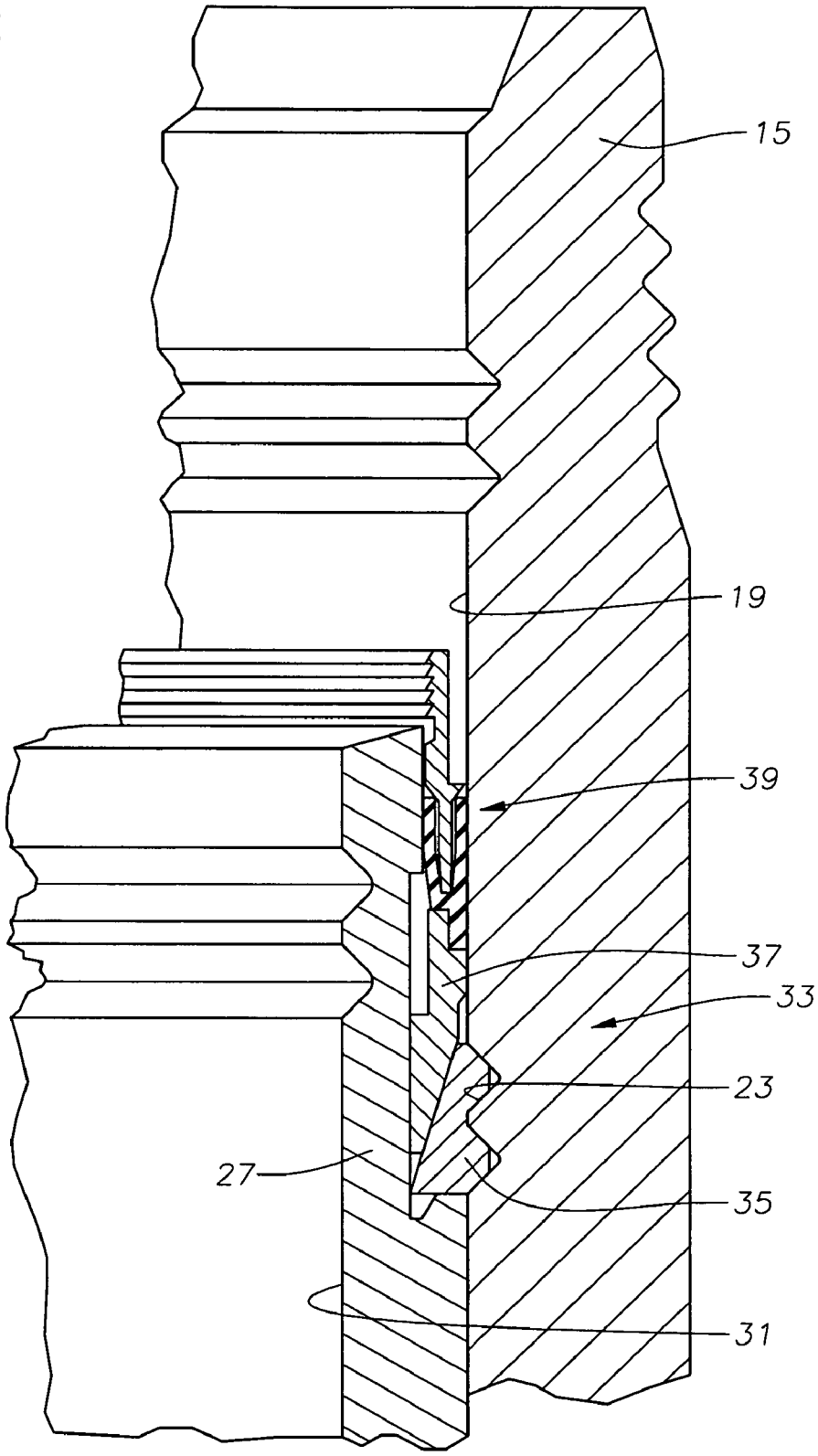
FIG. 2 is an enlarged sectional view of a portion of the adapter of FIG. 1 engaging the high pressure wellhead housing.

Referring to FIGS. 1 and 2, a low pressure wellhead housing 11 of a subsea well assembly is shown with a conductor pipe or casing 13 suspended therefrom. Low pressure wellhead housing 11 and conductor casing 13 are preferably a conventional outer wellhead housing and conductor string assembly as utilized by those skilled in the art. A high pressure wellhead housing 15 having an outer casing 17 suspended therefrom, lands within and is carried by low pressure wellhead housing 11. As will be readily appreciated by those skilled in the art, outer casing 17 extends into the subsea well to a deeper depth than conductor casing 13. High pressure wellhead housing 15 has a substantially tubular cross section with a bore 19 extending axially therethrough. A load shoulder 21 is formed in bore 19 of high pressure wellhead housing 15. In conventional wellhead assemblies, a casing hanger lands on load shoulder 21 with a string of casing suspended therefrom. Subsequently, additional casing hangers and strings of casing are landed within high pressure wellhead housing 15 during the drilling and completion process of the subsea well.

A grooved profile 23 is also formed within bore 19 of high pressure wellhead housing 15. As will be readily appreciated by those skilled in the art, grooved profile 13 is typically utilized for locking and sealing a tubing hanger or casing hanger assembly within high pressure wellhead housing 15. High pressure wellhead housing 15 is typically a conventional high pressure wellhead housing having an 18¾ inch inner diameter. Accordingly, casing hangers and tubing hangers interacting directly with high pressure wellhead housing 15 also have to have an outer diameter wide enough to engage bore 19. Therefore, a riser assembly having at least an 18¾ inch diameter must be utilized.

Alternatively, an adapter or adapter sleeve 27 is landed within bore 19 of high pressure wellhead housing 15. Adapter 27 typically has a 13⅝ inner diameter for interacting with casing hangers and/or tubing hangers with smaller circumferences. An external load shoulder 29 is formed on an exterior surface of adapter 27. External load shoulder 29 engages load shoulder 21 of high pressure wellhead housing 15 when adapter 27 lands within bore 19 of high pressure wellhead housing 15. Adapter 27 is also preferably a tubular member having an axial bore 31 extending therethrough. Adapter 27 preferably includes a locking assembly 33 for locking adapter 27 in place relative to high pressure wellhead housing 15. Locking assembly 33 also preferably sealingly engages adapter 27 with bore 19 of high pressure wellhead housing 15.

Referring to FIG. 2, locking assembly 33 preferably includes an outer locking ring 35, which could be a split ring or a C-ring, having an outer profile that matingly engages grooved profile 23 of high pressure housing 15. Locking ring 35 is preferably biased inward when adapter 27 is lowered inside of high pressure wellhead housing 15. When external load shoulder 29 of adapter 27 lands upon load shoulder 21 of high pressure wellhead housing 15, a cam member 37 is operably actuated axially downward in order to cam locked ring 35 radially outward into engagement with grooved profile 23. Upon camming lock ring 35 radially outward into engagement with grooved profile 23, locking assembly is actuated to its locked position, thereby locking adapter 27 in place relative to high pressure wellhead housing 15.

A seal assembly 39 is preferably positioned adjacent cam member 37 so that as cam member 37 is actuated with a running tool, seal assembly 39 is also moved into engagement with bore 19 of high pressure wellhead housing 15 and the exterior surface of adapter 27. In the preferred embodiment, seal assembly 39 is a metal to metal seal arrangement as known by those skilled in the art.

Figure 3A:
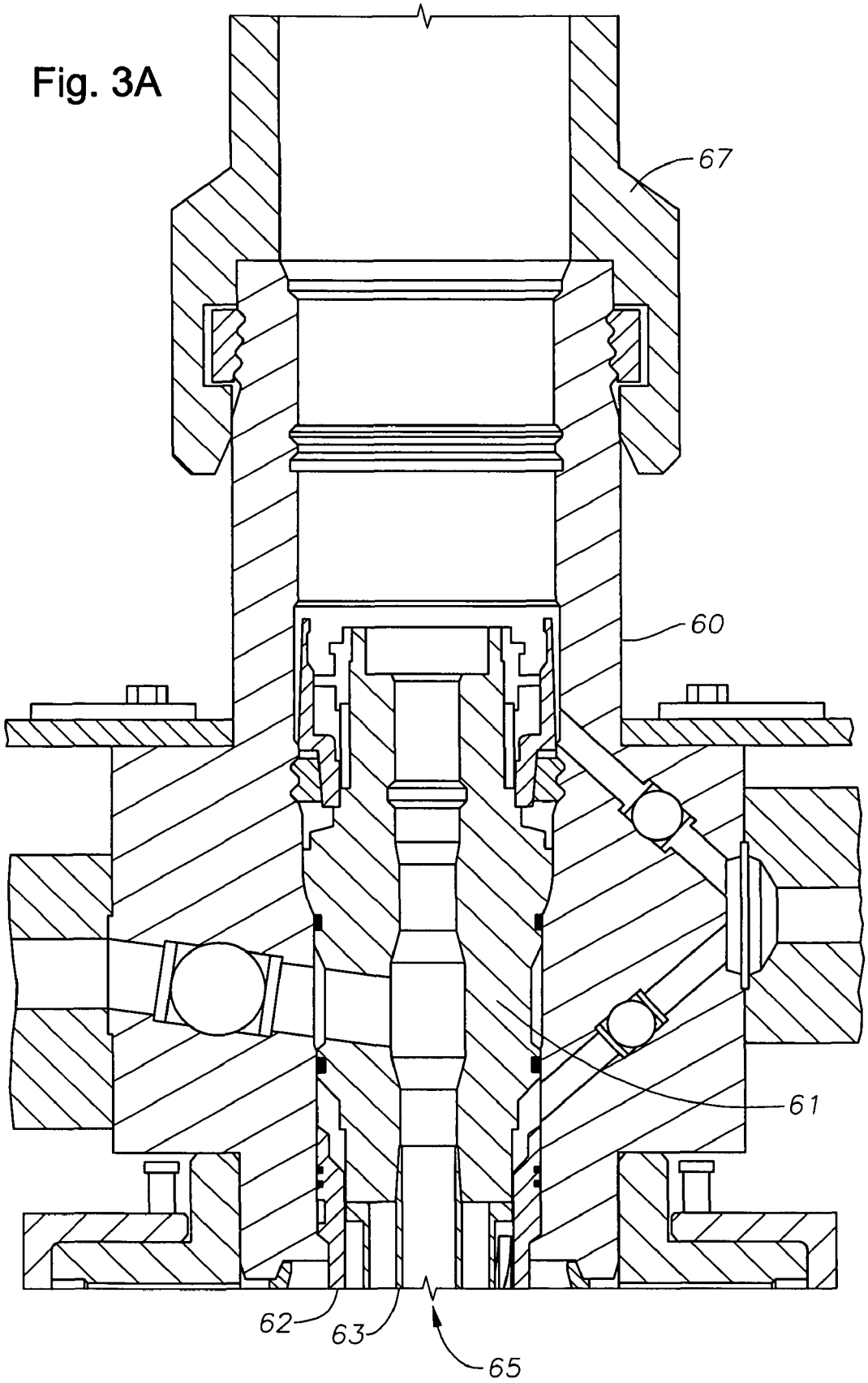
FIG. 3A is a sectional view of an upper portion of a subsea well that is drilled with a subsea tree assembly.
Figure 3B:
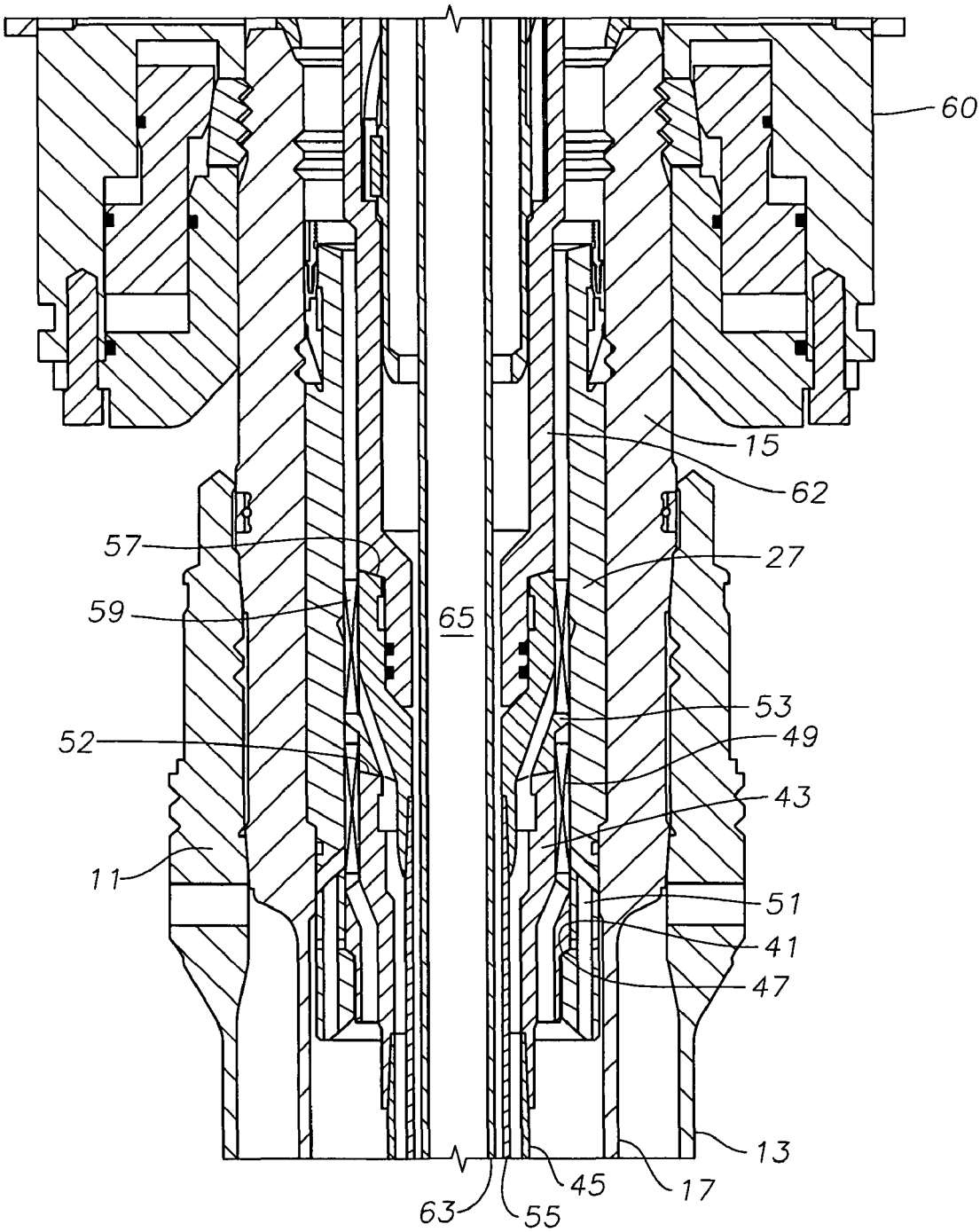
FIG. 3B is a sectional view of a lower portion of a subsea well that is drilled with a subsea tree assembly, and having the adapter of FIG. 1 within the high pressure wellhead housing.

As best shown in FIGS. 1 and 3B, adapter 27 also preferably includes an internal load shoulder 41 formed within bore 31. A casing hanger 43, having a string of casing 45 attached thereto, is lowered within bore 19 of high pressure wellhead housing 15 and bore 31 of adapter 27. An external load shoulder 47, formed on an outer surface of casing hanger 43, engages and lands upon load shoulder 41 of adapter 27 as casing hanger 43 is lowered within bore 31. A seal assembly 49 operably engages casing hanger 43 and bore 31 of adapter 27. As will be readily appreciated by those skilled in the art, seal assembly 49 is operable with a running tool (not shown) that can be suspended from the end of a drilling pipe or a wire line.

A flow by port 51 is preferably formed in a lower portion of adapter 27. Flow by port 51 has an opening toward a lower end of adapter 27, and extends axially upward and radially inward to an opening in bore 31 at an axial position above load shoulder 41. In the preferred embodiment, there is a plurality of flow by ports 51 formed in the lower portion of adapter 27 for the flow of cement during the cementing process of casing 45 within the subsea well. As will be readily appreciated by those skilled in the art, bore 31 is in fluid communication with an annulus formed between the outer surface of string of casing 45 and the inner surface of string of outer casing 17. In the preferred embodiment, seal assembly 49 is actuated into sealing engagement between casing hanger 43 and bore 31 after flow by ports 51 are utilized during the cementing process.

Casing hanger 43 includes an upper end 52 extending radially inward from bore 31. Another casing hanger 53 having a string of casing 55 extending therefrom is also lowered into the subsea well through bore 19 of high pressure wellhead housing 15 and bore 31 of adapter 27. A load shoulder 57 formed on an external surface of casing hanger 59 engages and lands upon upper end 52 of casing hanger 43. In the preferred embodiment, string of casing 59 extends into the subsea well to a production depth and is cemented into place. A seal assembly 59 is associated with casing hanger 53 for sealingly engaging 53 to bore 31 of adapter 27. Seal 59 is also operably actuated in to and out of engagement with a running tool suspended from a wire line or a drill string.

Referring to FIGS. 3A and 3B, a subsea tree 60 lands upon an upper end of high pressure wellhead housing 15 and engages grooved profile 25 on the exterior of high pressure wellhead housing 15. Tubing hanger 61 is carried within tree 60 for suspending a string of tubing or production tubing 63 into the subsea well. String of tubing 63 extends from tubing hanger 61 located in subsea tree 60 through a stab and tie-back assembly 62 extending from a lower portion of subsea tree 60 and engaging casing hanger 53 within bore 31 of adapter 27. Stab and tie-back assembly 62 sealingly engages casing hanger 53 in a matter known in the art for sealingly connecting tubing hanger 61 with casing hanger 53 within bore 31 of adapter 27. String of tubing 63 extends from tubing hanger 61 through stab and tie-back assembly 62 and through casing hanger 53 and string of casing 55 to the production depth of the subsea well. A production passage 65 receives well fluids from the subsea well for conveyance to the subsea tree after perforation of the subsea well.

In the preferred embodiment, a drilling riser 67 is connected to an upper end portion of tree 60. In the embodiments shown in FIGS. 3A and 3B, casing hanger 43, with string of casing 45 attached thereto, is lowered through drilling riser 67 and the bore of subsea tree 60 into bore 19 of high pressure wellhead housing 15, for load shoulder 47 to land upon load shoulder 41 of adapter 27. Casing hanger 53, with string of casing 55 attached thereto, is then lowered through drilling riser 67 and the bore of tree 60 for landing upon upper end 52 of casing hanger 43.

As will be readily appreciated by those skilled in the art, adapter 27 allows an operator to lower casing hanger 43 and casing hanger 53 having smaller diameters through a narrow diameter drilling riser 67 and through the bore of subsea tree 60. As will also be readily appreciated by those skilled in the art, such an assembly is typically less expensive than a wide bore drilling riser and casing hangers adapted to land within an 18¾ inch bore of high pressure wellhead housing 15. As will also be readily appreciated by those skilled in the art, the operator also has the option of not using adapter 27 and completing the subsea well by landing casing hangers adapted to land within the 18¾ inch bore of high pressure wellhead housing 15 in a conventional manner, thereby providing the operator with the flexibility to utilize more than one drilling package for completing a well.

Figure 4:
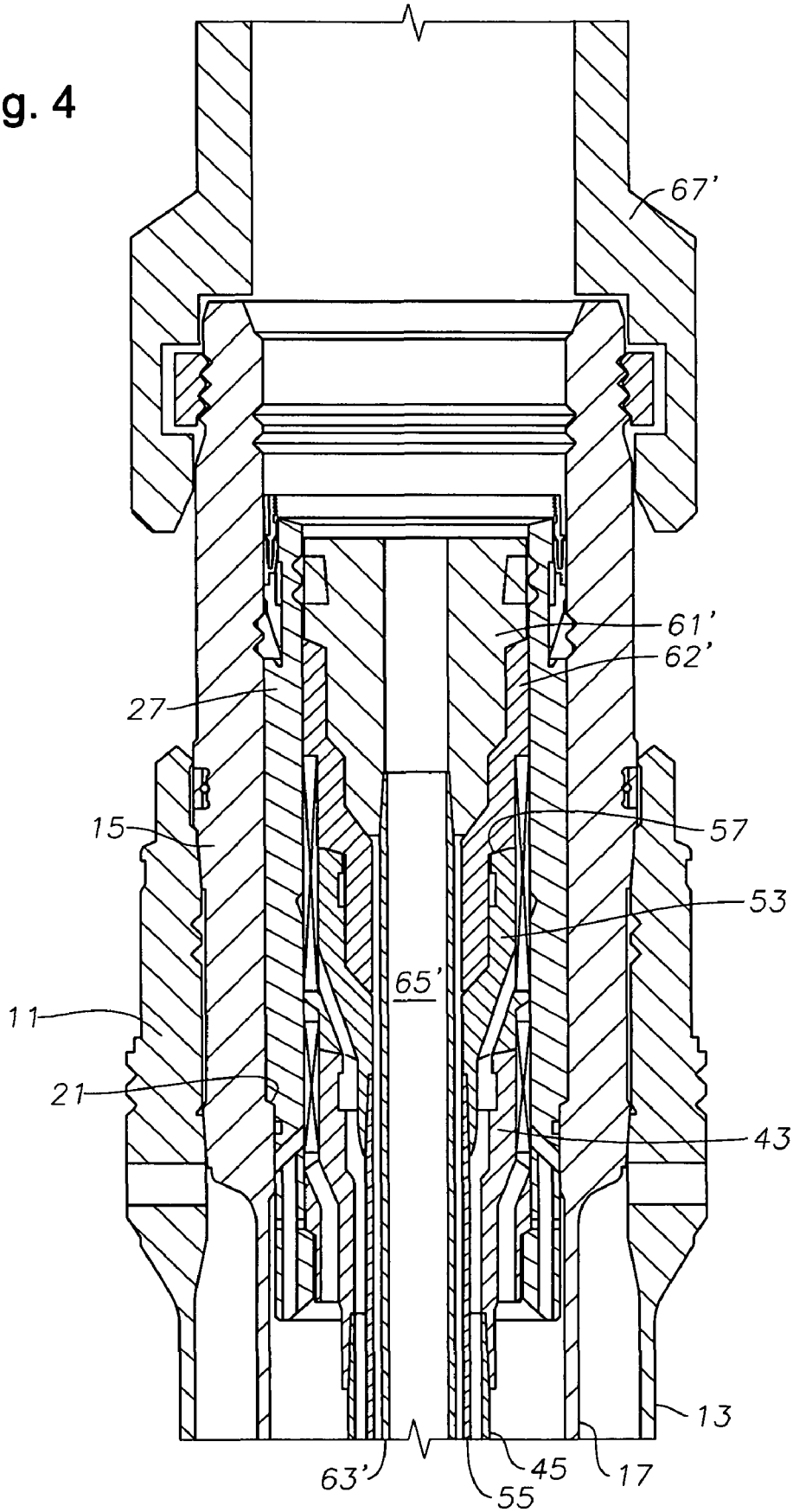
FIG. 4 is a sectional view of a subsea well that is drilled with a drilling riser and blowout preventer attached to the high pressure wellhead housing, and having the adapter of FIG. 1 within the high pressure wellhead housing.

Referring to FIG. 4, low pressure wellhead housing 11, high pressure wellhead housing 15, and adapter 27 are installed in the same manner as the previous embodiment. In the embodiment shown in FIG. 4, however, casing hangers 43 and 53 with their associated strings of casing 45, 55 are lowered through a BOP and drilling riser assembly 67' which connects to outer grooved profile 25 of high pressure wellhead housing 15 rather than on a subsea tree. In the embodiment shown in FIG. 4, tubing hanger 61' is carried within high pressure wellhead housing 15. Tubing hanger 61' is carried within bore 31 of adapter 27. A bushing and lock-down sub assembly 62' lands within bore 31 of adapter 27 upon load shoulder 57 located at the upper end of casing hanger 53. Bushing 62' is a wearable bushing upon which tubing hanger 61' lands within adapter 27. A string of tubing 63' is suspended from tubing hanger 61' defining a production passageway 65' extending axially therethrough for the conveyance of well fluid from the subsea well.

Utilizing adapter 27 allows an operator to land and install casing hangers and/or tubing hangers through a riser connected to grooved profile 25 on the exterior of high pressure wellhead housing 15, or through a subsea tree assembly connected to grooved profile 25 of high pressure wellhead housing 15. As will be readily appreciated by those skilled in the art, typical tree assemblies do not have a bore allowing casing hangers with an 18¾ inch outer diameter to be lowered therethrough, but allow casing hangers and tubing hangers having 13⅝ inch outer diameters to be lower therethrough. Accordingly, adapter sleeve allows an operator to lower casing and tubing hanger assemblies through both a riser assembly and a subsea tree assembly mounted to high pressure wellhead housing 15.

In both assemblies shown in FIGS. 3A and 3B and FIG. 4, the operator utilizes a narrower drilling riser 67, 67' for lowering and landing casing hangers 43, 53 and their associated strings of casing 45, 55 into the subsea well. Drilling riser 67, 67' are also utilized for lowering and landing tubing hangers 61, 61' with their associated strings of tubing 63, 63' into the subsea well. As will readily be appreciated by those skilled in the art, the use of a narrow bore drilling riser is less expensive than wide bore drilling risers. As will also be readily appreciated by those skilled in the art, adapter 27 can easily be installed within bore 19 of high pressure wellhead housing 15 with a lift line once a determination has been made whether to use casing hangers adapted to land within an 18¾ inch bore of high pressure wellhead housing 15 or casing hangers 43, 53 adapted to land and sealingly engage bore 31 of adapter 27 with a 13⅝ inch inner diameter. Such an advantage is useful to operators who arrive at a subsea well that has already been preinstalled with low pressure wellhead housing 11, conductor casing 13 and high pressure wellhead housing 15 and outer casing 17. Such an arrangement is also advantageous to drilling operators who realize that, based upon the equipment available at the surface, drilling through a subsea tree such as subsea tree 60, would be less expensive than drilling through a wide bore drilling riser.

While the invention has been shown in only three of its forms, it should be apparent to those skilled in the art that it is not so limited but is susceptible to various changes without departing from the scope of the invention.

The invention claimed is:

1. A subsea wellhead assembly for a subsea well, comprising:

a low pressure wellhead housing having a string of conductor piping extending therefrom;

a high pressure wellhead housing adapted to have a string of outer casing suspended therefrom and to land within the low pressure wellhead housing, the high pressure wellhead housing having a housing bore;

an adapter adapted to be positioned within the housing bore, the adapter having an external load shoulder adapted to land on a housing load shoulder of the high pressure wellhead housing and an adapter bore with an adapter load shoulder formed thereon;

a first casing hanger adapted to be carried in the adapter bore and to have a string of inner casing suspended therefrom, the first casing hanger being adapted to land on the adapter load shoulder;

a second casing hanger adapted to be carried in the adapter bore and to have a string of inner casing suspended therefrom, the second casing hanger being adapted to land on the first casing hanger;

a first metal seal assembly adapted to be disposed between the first casing hanger and the adapter to seal an annulus therebetween; and a second metal seal assembly adapted to be disposed between the second casing hanger and the adapter to seal an annulus therebetween.

2. The subsea assembly of claim 1, wherein a maximum sidewall thickness of the adapter is greater than a maximum sidewall thickness of the casing hanger.

3. The subsea assembly of claim 1, wherein a lower end of the adapter is free of connection to any conduit extending into the well.

4. The subsea assembly of claim 1, wherein a lower end of the adapter is free of connection to any conduit extending into the well and is axially below a lower end of the high pressure wellhead housing.

5. The subsea assembly of claim 1, wherein the adapter further comprises a plurality of flow by ports extending from a lower end portion of the adapter and opening into the adapter bore above the adapter load shoulder.

6. The subsea assembly of claim 1, wherein the casing hanger further comprises a hanger seal assembly that sealingly engages the casing hanger with the adapter bore.

7. The subsea assembly of claim 1, further comprising a tubing hanger landed on the second casing hanger and supporting a string of production tubing therefrom, the string of production tubing extending axially through the first casing hanger and the string of inner casing to a production depth within the well.

8. The subsea assembly of claim 1, wherein:

the high pressure wellhead housing further comprises an interior profile formed on the housing bore axially above the load shoulder of the high pressure wellhead housing; and the adapter further comprises a locking member, the locking member being operable to engage and disengage the interior profile.

9. The subsea assembly of claim 8, wherein the adapter further comprises an adapter seal assembly that sealingly engages the housing bore above the interior profile.

10. The subsea assembly of claim 1, further comprising:

a subsea tree assembly connecting to an exterior profile formed on the exterior surface of the high pressure wellhead housing; and a tubing hanger supporting a string of production tubing extending axially through from the subsea tree assembly through the casing hanger.

11. A subsea assembly for a subsea well, comprising:

a low pressure wellhead housing having a string of conductor piping extending therefrom;

a high pressure wellhead housing having a string of outer casing suspended therefrom, which lands within the low pressure wellhead housing, the high pressure wellhead housing having a housing bore with a housing load shoulder formed therein and an interior profile formed in the housing bore axially above the housing load shoulder;

an adapter positioned within the housing bore, the adapter having an external load shoulder that lands on the housing load shoulder, an adapter bore with an adapter load shoulder formed thereon, and a locking member operable to engage and disengage the interior profile, wherein a lower end of the adapter is free of connection to any conduit extending into the well and a lowermost end of the adapter is axially below a lower end of the high pressure wellhead housing;

a casing hanger carried in the adapter bore having a string of inner casing suspended therefrom, the casing hanger landing on the adapter load shoulder; and a plurality of flow by ports formed in the adapter that extend from a lower end portion of the adapter and open into the adapter bore above the adapter load shoulder.

12. The subsea assembly of claim 11, wherein:

the casing hanger further comprises a hanger seal assembly that sealingly engages the casing hanger with the adapter bore; and the adapter further comprises an adapter seal assembly that sealingly engages the adapter with the housing bore above the interior profile.

13. The subsea assembly of claim 11, further comprising:

a subsea tree assembly connecting to an exterior profile formed on the exterior surface of the high pressure wellhead housing; and a tubing hanger supporting a string of production tubing extending axially from the subsea tree assembly through the casing hanger and the string of inner casing to a production depth within the well.

14. The subsea assembly of claim 13, wherein the tubing hanger is carried within the subsea tree.

15. The subsea assembly of claim 13, wherein the tubing hanger lands within the adapter.

* * * * *

UNITED STATES PATENT AND TRADEMARK OFFICE

CERTIFICATE OF CORRECTION

PATENT NO. : 7,798,231 B2
APPLICATION NO. : 11/481587
DATED : September 21, 2010
INVENTOR(S) : David L. Ford It is certified that error appears in the above-identified patent and that said Letters Patent is hereby corrected as shown below:

In Column 1, Line 21, delete “sting” and insert -- string --, therefor.

In Column 1, Line 38, delete “subea” and insert -- subsea --, therefor.

In Column 3, Line 22, delete “sting” and insert -- string --, therefor.

Signed and Sealed this
Fifth Day of April, 2011

David J. Kappos

David J. Kappos
*Director of the United States Patent and Trademark Office*